US006286472B1

(12) United States Patent
Takahashi et al.

(10) Patent No.: US 6,286,472 B1
(45) Date of Patent: Sep. 11, 2001

(54) FOUR STROKE ENGINE

(75) Inventors: Masanori Takahashi; Goichi Katayama, both of Shizuoka (JP)

(73) Assignee: Sanshin Kogyo Kabushiki Kaisha, Shizuoka-ken (JP)

( * ) Notice: Subject to any disclaimer, the term of this patent is extended or adjusted under 35 U.S.C. 154(b) by 0 days.

(21) Appl. No.: 09/356,623

(22) Filed: Jul. 19, 1999

(30) Foreign Application Priority Data

Jul. 17, 1998 (JP) ..... 10-202608
Jul. 28, 1998 (JP) ..... 10-212089

(51) Int. Cl.[7] ..... B63H 21/26; F02M 35/10
(52) U.S. Cl. ..... 123/184.34; 123/184.42
(58) Field of Search ..... 123/184.42, 184.34, 123/184.38; 261/35

(56) References Cited

U.S. PATENT DOCUMENTS 5,133,307 * 7/1992 Kurihara ..... 123/184.38
5,713,771 * 2/1998 Takahashi et al. ..... 123/184.34
5,971,822 * 10/1999 Ohta et al. ..... 123/184.42
6,085,713 * 7/2000 Wada ..... 123/184.42
6,131,890 * 10/2000 Fischer et al. ..... 261/35

* cited by examiner

*Primary Examiner*—Marguerite McMahon
(74) *Attorney, Agent, or Firm*—Knobbe, Martens, Olson & Bear, LLP

(57) ABSTRACT

A four stroke engine having at least two cylinders spaced vertically relative to each other. Each cylinder includes a cylinder body having a cylinder bore extending generally horizontally. Plurality of air intake ducts are provided for connecting a common plenum chamber and respective air intake passages which extends to respective combustion chambers. Each of the air intake ducts has a generally straight section extending generally horizontally and parallel to each other. The distance between the straight sections is less than the distance between the axes of the cylinder bores. Also, in another feature, throttle body means are interposed between duct members, which are upstream components of the air intake ducts, and the intake passages for controlling the flow of air to the combustion chambers.

26 Claims, 9 Drawing Sheets

FOUR STROKE ENGINE

BACKGROUND OF THE INVENTION

1. Field of the Invention

This invention relates to a four stroke engine and more particularly to an air induction system of a four stroke engine, which is most suitable to an outboard motor.

2. Description of Related Art

Recently, some outboard motors incline to utilize four stroke engines. One reason for this tendency is that emissions from the four stroke engines are clean rather than those of two stroke crankcase compression engines. Also, usually the engines have multiple cylinders in order to produce relatively large power. The respective cylinders are spaced vertically relative to each other in those engines for outboard motors. That is, cylinder bores extend generally horizontally.

An air induction system is provided for introducing air charge to combustion chambers in the cylinders. The air induction system has air intake ducts extending generally horizontally along the cylinder bores and a common plenum chamber placed upstream of the air intake ducts. It is desirable to make the air intake ducts proper lengths for improving engine power, particularly the torque characteristic under acceleration conditions from low or medium speeds by using the inertia charge effect. Also, the plenum chamber has a certain volume and a height so that the air intake ducts are connected thereto.

On the other hand, however, the engine is encircled with a protective cowling and a number of engine components must be placed in narrow room formed between the engine body and the protective cowling. Under the circumstances, it is a problem how to make sufficient space for placing the engine components as well as the air intake ducts and the plenum chamber.

It is, therefore, a principal object of this invention to provide a four stroke engine wherein a certain space can be available for placing engine components other than the air intake ducts and the plenum chamber.

Also, as described above, the air intake ducts must have certain lengths. In the meantime, usually a throttle valve for admitting air charge to combustion chambers is contained in a throttle body placed upstream of the plenum chamber. Due to this arrangement, lengths between the throttle valve and the respective combustion chambers tend to be relatively long. Thus, the engine cannot response so quickly to the operator's desire. Accordingly, the operator is likely to have bad feeling in engine operation.

It is, therefore, another object of this invention to provide a four stroke engine that can response quickly to the operator's desire in engine operation.

SUMMARY OF THE INVENTION

In accordance with one aspect of this invention, a four stroke internal combustion engine comprises a plurality of generally horizontally extending bores having their axis spaced vertically relative to each other. A plurality of pistons are provided and each piston reciprocates within a respective one of the cylinder bores. A cylinder head closes one end of the cylinder bores. Each of the cylinder bores, the pistons and the cylinder head generally defines a respective combustion chamber for burning an intake charge. The cylinder head has a plurality of air intake passages communicating with the combustion chambers for supplying at least air charge thereto. The engine further comprises a plurality of air intake ducts each connected to a respective one of the air intake passages. Each of the air intake ducts has a generally straight section extending generally horizontally and parallel to each other. The distance between the straight sections is less than the distance between the axes of the cylinder bores.

In accordance with another aspect of this invention, a four stroke internal combustion engine comprises a plurality of generally horizontally extending, vertically spaced cylinder bores. A plurality of pistons are provided and each piston reciprocates within a respective one of the cylinder bores. A cylinder head closes one end of the cylinder bores. Each of the cylinder bores, the pistons and the cylinder head generally defines a respective combustion chamber for burning an intake charge. A crankcase member closes the other ends of the cylinders and defining at least in part a crankcase chamber in which a crankshaft driven by the piston rotates. The cylinder head has a plurality of air intake passages each communicating with a respective one of the combustion chambers for supplying at least an air charge thereto. A plenum chamber has an atmospheric air inlet juxtaposed to the crankcase member. A plurality of generally horizontally extending, vertically spaced duct members extends from the plenum chamber along one side of the engine toward the cylinder head intake passages. Throttle body means is interposed between the duct members and the cylinder head intake passages for controlling the flow of air to the combustion chambers.

Further aspects, features and advantages of this invention will become apparent from the detailed description of the preferred embodiments which follow.

DETAILED DESCRIPTION OF THE PREFERRED EMBODIMENTS OF THE INVENTION

Figure 1:
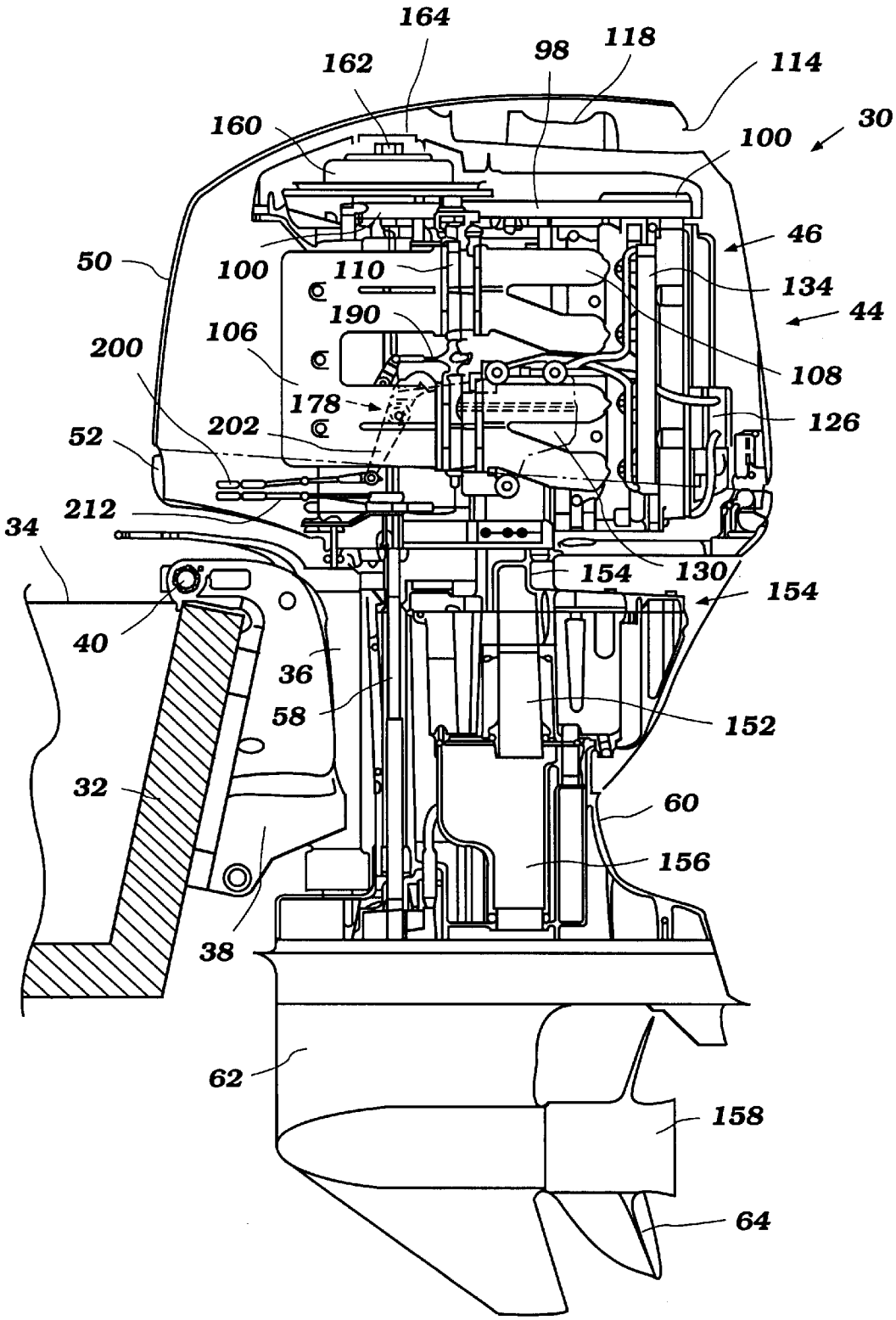
FIG.1 is a partly cross-sectional, side elevational view showing an outboard motor embodying features of this invention and mounted on an associated watercraft which is partially shown. A protective cowling, an engine cover and an upper housing including an exhaust system are sectioned to show an engine, engine components and a certain structure of the outboard motor under the engine.
Figure 2:
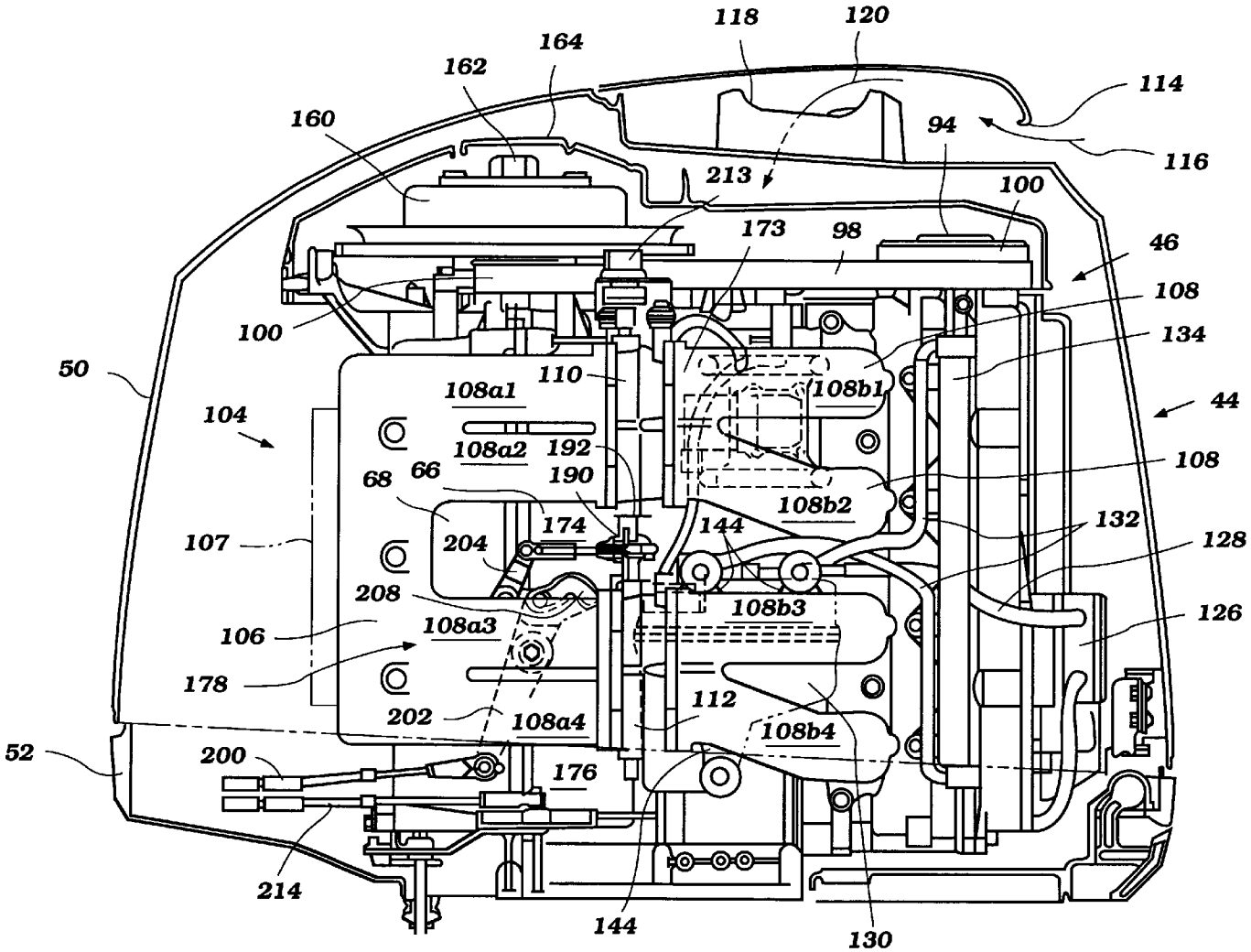
FIG. 2 is an enlarged, side elevational view showing a power head of the outboard motor. The protective cowling and the engine cover are also sectioned.

At first, the general overall environment of an exemplary outboard motor wherein the invention is practiced will be described primarily with reference to FIGS. 1 through 4.

An outboard motor 30 is mounted on a transom 32 of an associated watercraft 34 by a swivel bracket 36 and a cramp bracket 38. The whole body of the outboard motor 30 is pivotally supported around a generally vertically extending axis of the swivel bracket 36 and this connection allows the whole body of the outboard motor 30 to be steered in a suitable manner. Meanwhile, it is also pivotally supported around a horizontally extending axis 40 of the cramp bracket 38 so that its tilting movement and trimming movement are practicable also.

In the following descriptions, the term "forward" or "forwardly" will mean at or to the side where the cramp bracket 38 is located and the term "rearward" or "rearwardly" will mean at or to the opposite side of this forward side unless described otherwise.

A power head 44 is located at the top of the outboard motor 30. The power head 44 includes a powering internal combustion engine 46. This engine 46 operates on a four stroke principle and has four cylinders 48 disposed in line and spaced vertically relative to each other. The power head 44 further includes a top cowling 50 and a bottom cowling 52. These top and bottom cowlings 50,52 generally completely encircle the engine 46 so as to protect it. For instance, water is prevented from splashing over the engine 46. The top cowling 50 is detachably affixed to the bottom cowling 52 so as to ensure access to the engine 46 for maintenance.

The engine 46 has a crankshaft 56 (see FIG. 3 or FIG. 4) extending generally vertically. Since the body of the outboard motor 30 can be tilted as noted above, the term "vertically extending" means that the body of outboard motor 30 is in the non-tilted position (including the non-trimmed position), i.e., in the most lowered position as shown in FIG. 1 and thus the crankshaft 56 is extending perpendicularly. Also, the term "horizontally extending" means extending in a plane making a right angle with a perpendicular plane. In addition, the term "the body of the outboard motor 30" does not include the swivel bracket 36 and the cramp bracket 38 unless explained otherwise.

A driveshaft 58 continues from the crankshaft 56 and extends vertically and downwardly in an upper housing 60 and also a lower housing 62. The bottom end of the driveshaft 58 is connected with a propeller shaft (not shown) extending generally horizontally by means of a bevel gear transmission (not shown). At the end of the propeller shaft, a propeller 64 is affixed. Through the crankshaft 56, driveshaft 58, the bevel gear transmission and the propeller shaft, the engine 46 powers the propeller 64.

Figure 3:
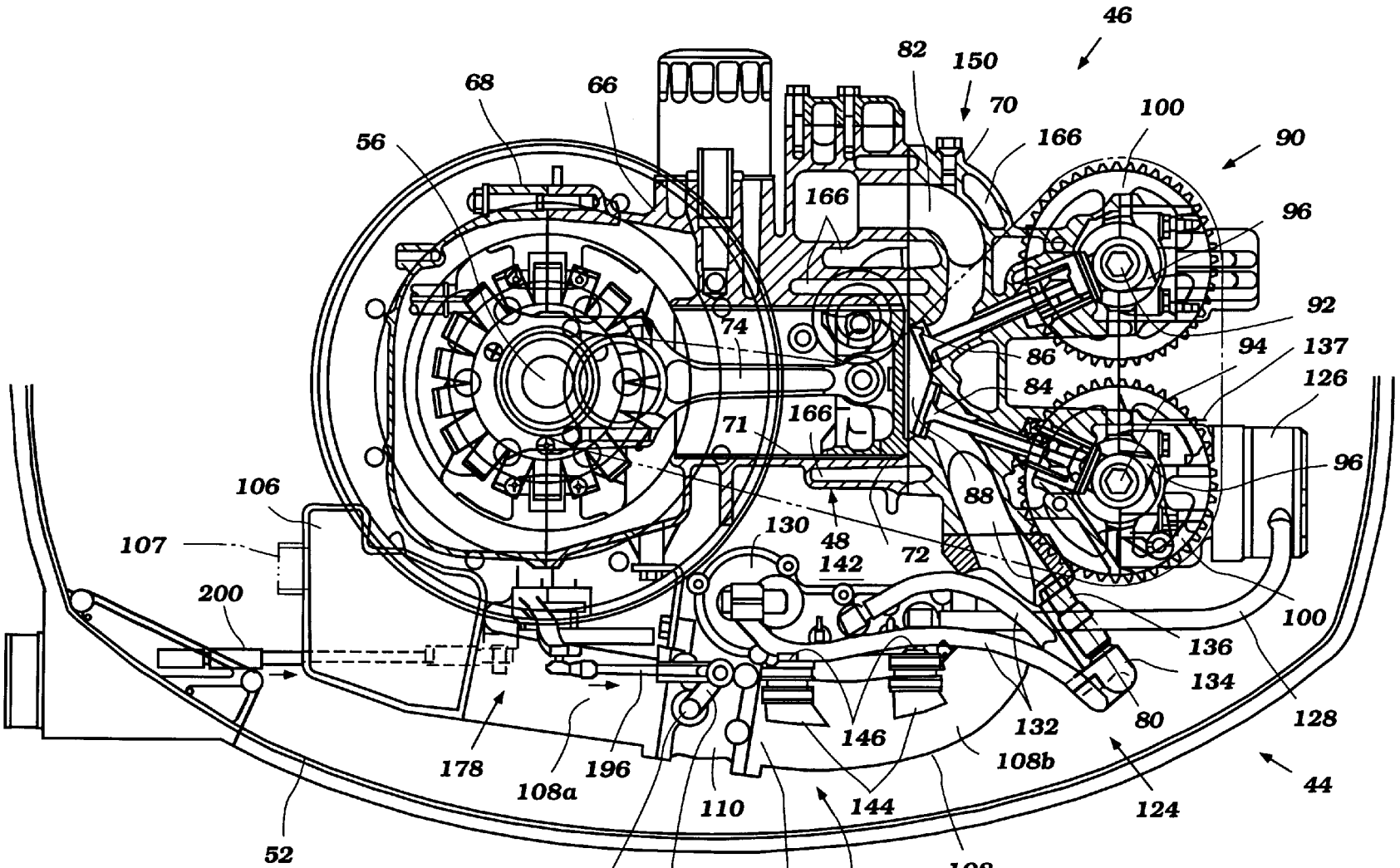
FIG. 3 is a top plan view showing the power head. A certain cylinder is sectioned at a plane including its intake and exhaust passages, while a plenum chamber is sectioned generally at its vertical center line. Only a half part of the protective cowling on the port side is shown. Also, a flywheel and a camshaft drive are shown in phantom since these components not actually be seen in this cross-section.
Figure 4:
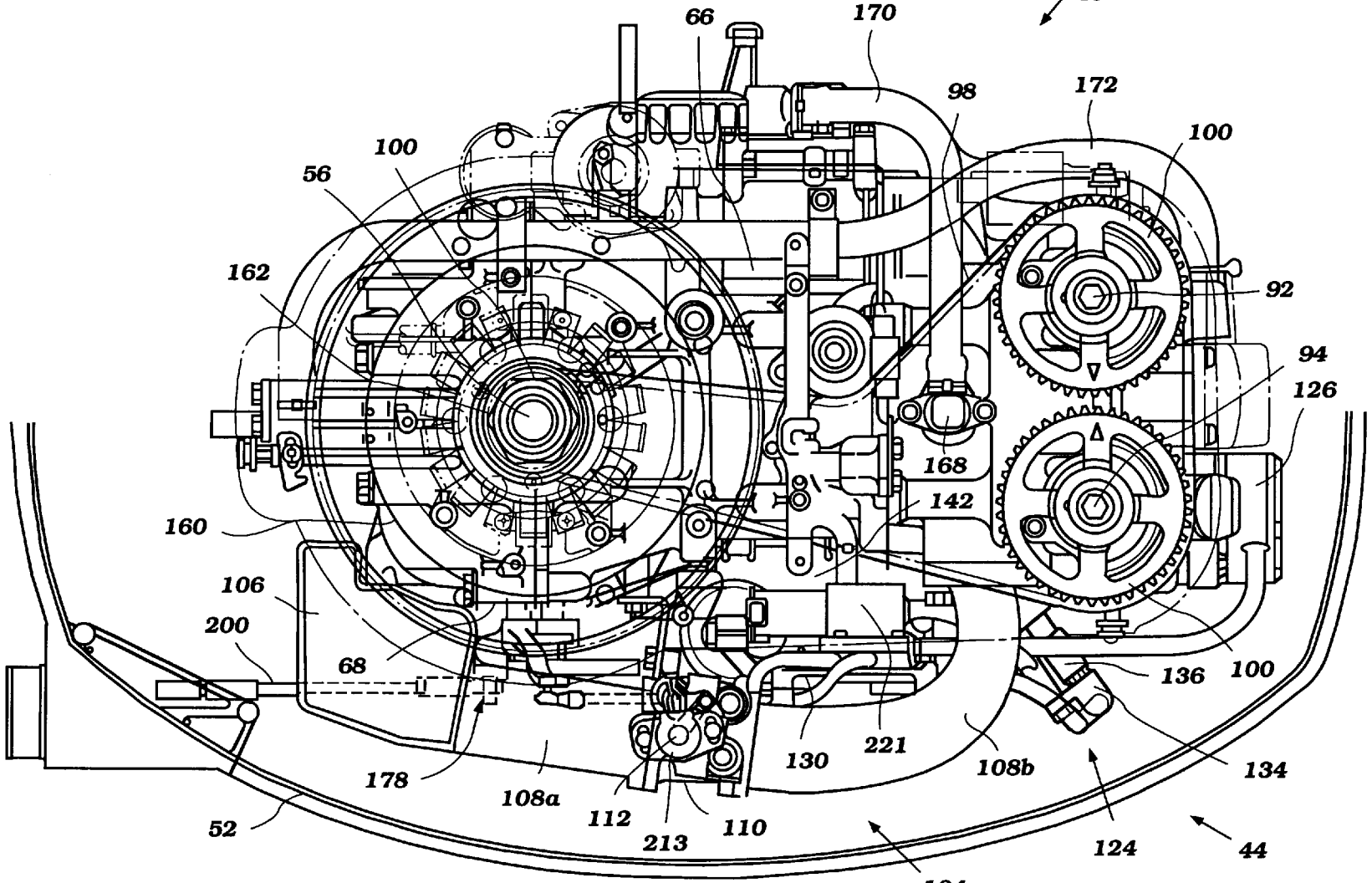
FIG. 4 is another top plan view of the power head looking along the camshaft drive thereof. Like in FIG. 3, the plenum chamber is sectioned generally at its vertical center line and only the half part of the protective cowling on the port side is shown.

As best seen in FIG. 3, the engine 46 generally comprises a cylinder block 66, a crankcase chamber 68 and a cylinder head 70 and all members of these sections 66,68,70 are generally made of aluminum alloy casting. The cylinder block 66 generally has two openings. One opening is closed by the cylinder head 70. The cylinder head 70 is located at the most rearward position. Another opening is closed by the crankcase 68 defined by one or more crankcase members. The crankcase 68 is placed at more forward position. The cylinder block 66 contains four cylinders 48 therein as noted above. Each cylinder 48 has a cylinder bore 71, which axis extends generally horizontally and a piston 72 reciprocates therein. The pistons 72 are connected to the crankshaft 56 located in the crankcase chamber 68 via connecting rods 74 so that the reciprocal movement of the pistons 72 rotates the crankshaft 56.

Air intake passages 80 and exhaust passages 82 are formed in the cylinder head 70. The exhaust passages 82 further extends in the cylinder block 66. Each air intake passage 80 has one or more intake valves 84, while each exhaust passage 82 has also one or more exhaust valves 86. The air intake passage 80 and the exhaust passage 82 are branched off to sub-passages corresponding to respective valves 84,86. The cylinder bore 71, the piston 72, the cylinder head 70, the intake valves 84 and the exhaust valves 86 generally define a combustion chamber 88.

The intake valves 84 and the exhaust valves 86 are activated by a camshaft drive mechanism 90. That is, the air intake passages 80 and the exhaust passages 82 will be connected or disconnected to the combustion chambers 88 when the intake valves 84 and the exhaust valves 86 are brought into open or closed positions by the camshaft drive mechanism 90. The camshaft drive mechanism 90 has an intake camshaft 92 and an exhaust camshaft 94 both having cam lobes 96. When these camshafts 92,94 rotate, the cam lobes 96 activate the intake valves 84 and the exhaust valves 86 to open or close the air intake passages 80 and the exhaust passages 82.

Both of the camshafts 92,94 are rotated by the crankshaft 56 with a cog belt or chain 98 as an endless transmitter. For this driving purpose, pulleys or sprockets 100 as a driving wheel and driven wheels are affixed on the camshafts 92, 94 and the crankshaft 56 in a suitable manner such as press fit and bolt-on and the endless transmitter 98 is wound around these driving and driven wheels 100. The open and close timings of the intake valves 84 and the exhaust valves 86 are determined by means of the arrangement of the cam lobes 96 on the camshafts 92,94 and the relationships in the rotational speeds of the camshafts 92,94 versus the crankshaft 56. The camshafts 92,94 are rotated at a half speed of the crankshaft 56.

Intake charge, which is mixture of air and fuel, is burnt in the combustion chambers 88 every combustion or burning stroke. Air is introduced to the combustion chambers 88 by an air induction system 104 extending generally horizontally on the port side of the engine 46.

The air induction system 104 includes a plenum chamber 106, air intake ducts 108, throttle bodies 110 and the air intake passages 80 in the cylinder head 70. In this embodiment, the air intake ducts 108 are made of aluminum alloy casting and formed with upstream duct members 108*a* and intake manifolds 108*b*. The upstream duct members 108*a* are integrated with the plenum chamber 106. The air intake passages 80 in the cylinder head 70 generally go slightly rearward and the intake ducts 108, then, turn forwardly and go forward generally along curvature of the top cowling 50 to the plenum chamber 106. This curvature is temperate because air charge can flow without confronting particular resistance. As best seen in FIG. 3, the intake ducts 108 extend generally along the sides of the cylinder bores 71.

The plenum chamber 106 is provided for smoothing air charge therein. That is, the plenum chamber 106 primarily prevents intake pulsation and, in addition, precludes the intake pulsation in respective cylinders 48 from influencing to each other. The plenum chamber 106 is positioned generally opposite side of the air intake passages 80. In other words, the air intake passages 80 are placed at a generally rearward position of the engine 46, while the plenum chamber 106 is placed at a generally forward position of the engine 46. The plenum chamber 106 has an atmospheric air inlet opening 107 juxtaposed to the crankcase 68.

Throttle body means comprising a throttle body 110 and a throttle valve (not shown) positioned therein are interposed between the upstream duct members 108*a* and the intake manifolds 108*b*. The throttle body means are provided for controlling the flow of air to the combustion chambers 88. The throttle bodies 110 are relatively precisely machined and has straight center lines. The throttle valve in each throttle body 110 is affixed to a valve shaft 112 extending generally vertically. All of the valve shafts 112 are linked together and rotatable so that the throttle valves are opened or closed. This vertical arrangement of the valve shafts 112 is useful because related members will not project sideways. A throttle valve control mechanism will be described more in detail later.

Air is, at first, introduced into inside of the top and bottom cowlings 50,52 from an air inlet opening 114 formed at the top and rear portion of the top cowling 50 as indicated by the arrow 116. Then, the air goes through air funnels 118 as indicated by the arrow 120 and finally reaches the air inlet opening 107 of the plenum chamber 106. The air is, then, supplied through the air induction system 104 to the combustion chambers 88. The inlet opening 107 can be positioned at any side of the plenum chamber 106, i.e., for example, at the forward side as shown in phantom line (see FIGS. 2 and 3). The air induction system 104 will be described again later.

The engine 46 has a fuel supply system 124 for supplying fuel, which is another component of the intake charge, to the combustion chambers 88. Gasoline is used as the fuel in this engine 46. The fuel supply system 124 generally includes a fuel supply tank (not shown), a fuel pump 126, a fuel supply conduit 128, a vapor separator 130, fuel delivery conduits (including a return conduit) 132, a fuel rail 134 and fuel injectors 136. The fuel supply tank is placed on the associated watercraft 34 and connected to the fuel pump 126 with a conduit (not shown). Fuel is sent to the fuel pump 126. The fuel pump 126 is affixed on a camshaft cover 137 and raises pressure in the fuel. The fuel is supplied to the vapor separator 130. The vapor separator 130 is provided for discharging vaporized fuel to the atmosphere, if any. The vapor separator 130 is placed at a space 142 defined between the cylinder block 66 and the air intake ducts 108. Also, it is mounted on brackets 144 formed at one of the intake manifold 108*b* with bolts 146.

The pressurized fuel is delivered to the fuel rail 134 through the fuel delivery conduit 132. The fuel rail 134 is a rigid pipe and further delivers the fuel to the respective fuel injectors 136. The fuel injectors 136 are affixed on the cylinder head 70 so that their injector nozzles (not shown) are exposed to the air intake passages 80. The nozzles are directed to the combustion chambers 88 and spray the fuel into the intake passage 80 in the proximity of the intake valves 84.

The timing and the fuel amount are controlled by a computerized control device (not shown). Thus, the sprayed fuel is mixed with the air in the air intake passage 80 and forms the intake charge or air fuel mixture. This intake charge is introduced into the combustion chambers 88 when the intake valves 86 are opened. Excess fuel is returned to the vapor separator 130 through the delivery (return) conduit 132.

Usually, the vapor separator 130 is mounted on the cylinder block 66 that tends to have much heat. However, the vapor separator 130 in this arrangement is affixed to the intake manifold 108*b*. As aforenoted, the intake duct members 108*a,b* are made of aluminum alloy casting. This material has very good thermal conductivity. In addition, air, which is relatively cool, flows therethrough. Under these good conditions, the vapor separator 130 will not be heated and rather than be cooled down. This is useful in restoring vapor to the liquid state.

Although not shown, the engine 46 has a firing system. The firing system includes spark plugs that are affixed at the cylinder head 70 so that firing electrodes are exposed to the respective combustion chambers 88. Firing timings are controlled by the computerized control device and intake charge is burnt every combustion cycle.

The engine 46 further has an exhaust system 150 for discharging the burnt charge or exhaust gasses from the combustion chambers 88 outside of the engine 46 and finally outside of the outboard motor 30. The exhaust system 150 includes the aforenoted exhaust passages 82, exhaust conduits or manifold 152 partly formed in an exhaust guide 154 (see FIG. 1) which is located under the engine 46 and partly formed in the upper housing 60 and an exhaust expansion chamber 156 in the upper housing 60. The exhaust gasses flow through the exhaust passages 82, the exhaust conduits 152 and then the exhaust expansion chamber 156. When going through the exhaust expansion chamber 156, exhaust noise is effectively attenuated and the exhaust gasses are discharged into the body of water surrounding the outboard motor 30 through a passage (not shown) formed in the lower housing 62 and a boss 158 of the propeller 64.

At the top of the crankshaft 56, a flywheel 160 is affixed with a nut 162. The flywheel 160 contains electric power generator components therein and hence forms a flywheel magneto also. The generated power will be used for firing the spark plugs and other purposes. An engine cover 164 is affixed on the engine 46 in a suitable manner to cover up the top of the engine 46. That is, the rotational members such as the flywheel 160, the driven wheels 100 and the endless transmitter 98 are completely covered so that the operator will not be hurt even in case the top cowling 50 is detached during the engine operation.

The engine 46 has a water cooling system comprising water jackets 166 formed in the cylinder block 66 and the cylinder head 70. The water cooling system has also a thermostat 168 to adjust water temperature and a water discharge pipe 170 is provided (see FIG. 4).

Incidentally, a blow-by gas passage 172 is provided for returning blow-by gasses from the cylinder head 70 to the crankcase 68.

The air induction system 104 will now be described more in detail still with reference to FIGS. 1 through 4.

As described above, the air induction system 104 has the upstream duct members 108*a* integrated with the plenum chamber 104. The upstream duct members 108*a* are, more specifically, constructed with four branch ducts 108*a*1,*a*2, *a*3,*a*4. Meanwhile, the intake manifold 108*b* are also constructed with four runners 108*b*1,*b*2,*b*3,*b*4. The two runners 108*b*1,*b*2 are integrated with each other to form one intake manifold, while the other two runners 108*b*3,*b*4 are also integrated together to make another intake manifold. The throttle bodies 110 connects the respective upstream branch ducts 108*a*1,*a*2,*a*3,*a*4 and the runners 108*b*1,*b*2,*b*3,*b*4 so that four lines of the air intake ducts 108 are completed. That is, each line of the air intake ducts 108 is formed with at least three pieces that are the upstream intake duct member 108*a*, the throttle body 110 and the intake manifold 108*b*.

In the top plan view (see FIGS. 3), the upstream branch ducts 108*a*1,*a*2,*a*3,*a*4 extend generally horizontally along the cylinder bores 71. The runners 108*b*1,*b*2,*b*3,*b*4 extend also along the cylinder bores 71 in the top plan view, but are gradually curved and connected to the intake passages 80 as described above. However, at least a portion 173 positioned mostly upstream is formed straightly. That is, both of the upstream branch ducts 108*a*1,*a*2,*a*3,*a*4 and the potions 173 of the runners 108*b*1,*b*2,*b*3,*b*4 have straight axes. This is quite useful to dispose the throttle bodies 110 between them, because the throttle bodies 110 have also the straight axes as described above. In other words, the throttle bodies 110 are positioned at the portions of the intake ducts 108, which are the almost nearest to the combustion chambers 88 except the curved portions.

In the side elevational view (see FIG. 2), the upstream branch ducts 108*a*1,*a*2,*a*3,*a*4 extend generally horizontally and parallel to each other. The upstream branch ducts 108*a*1,*a*2,*a*3,*a*4 are straight sections. However, the intake manifolds 108*b* are slightly different. The lower runners 108*b*2,*b*4 are slanted so that the distance between the straight sections are less than the distance between the axes of the cylinder bores. In this regard, the cylinder bore axes extend generally horizontally at the same level of the center of the most downstream potion of the runners 108*b*1,*b*2,*b*3,*b*4 in this side view.

That is, the uppermost (first) runner 108*b*1 and the third runner 108*b*3 from the first brunch duct extend generally wholly straightly. Meanwhile, the second runner 108*b*2 and the lowermost (fourth) runner 108*b*4 are laid apart from the directly upper runner 108*b*1,*b*3, respectively, as going downstream so as to be connected to the intake passages 80. In other words, the second runner duct 108*b*2 and the lowermost (fourth) runner 108*b*4 extend closely to the runners 108*b*1,*b*3 which extend directly above as going upstream. Because of this arrangement, a space 174 is yielded between the second line and the third line of the intake ducts 108. Also another space 176 is yielded below the lowermost line of the air intake duct 108. The spaces 174, 176 are utilized for placing a throttle valve control mechanism 178. The throttle valve control mechanism 178 will be described more in detail later.

Generally, each of the air intake ducts 108 has a straight section 108*a*1,*a*2,*a*3,*a*4. These straight sections 108*a*1,*a*2,*a*3,*a*4 extend horizontally and parallel to each other. The distance between them is less than the distance between the axes of the cylinder bores. Therefore, a certain space such as the space 174, 176 can be made and these spaces can be utilized for engine components other than the throttle control mechanism 178.

In addition, if the uppermost line of the intake ducts 108 extend horizontally as this embodiment, the plenum chamber 106 can be placed at an appropriate position and hence the center of gravity of the engine 46 is not raised upward imprudently.

Also, since all of the lines of the intake ducts 108 extend horizontally or upwardly as going upstream, the fuel injected into the air intake passages 80 will not flow back upstream of the air intake ducts 108.

Further, the throttle bodies 110 are located at almost midway of the air intake ducts 108. That is, the throttle bodies 110 are nearer to the combustion chambers 88 than being located upstream of the plenum chamber 106. Accordingly, the engine 46 can response to the operator's requirement without much delay, i.e., more quickly as compared with the conventional arrangement. Accordingly, the operator will not have bad feeling in engine operation.

Some other arrangements of the air intake ducts 108 in this feature will be described later as examples.

Length of the induction system 104, more specifically, a total length of air intake duct 108 and the continuing intake passage 80 is an important element in effectively utilizing the inertia charge. That is, if the total length is selected properly, air charge will continue to rush into the combustion chambers 88 by its inertia even after the pistons 72 pass the bottom dead center and turn to move upwardly at a certain range of the engine operation. This phenomenon results in a great improvement of the volumetric efficiency or the charging efficiency. This means that the amount of air entering the combustion chambers 88 per induction stroke greatly increases.

In this regard, however, the second and fourth lines of the air intake ducts 108 are slightly longer than the uppermost and third lines because these runners 108*b*2,*b*4 are inclined as described above. It is desirable that all of the air intake ducts 108 have the same length that is suitable for obtaining the intake inertia effect.

Figure 5:
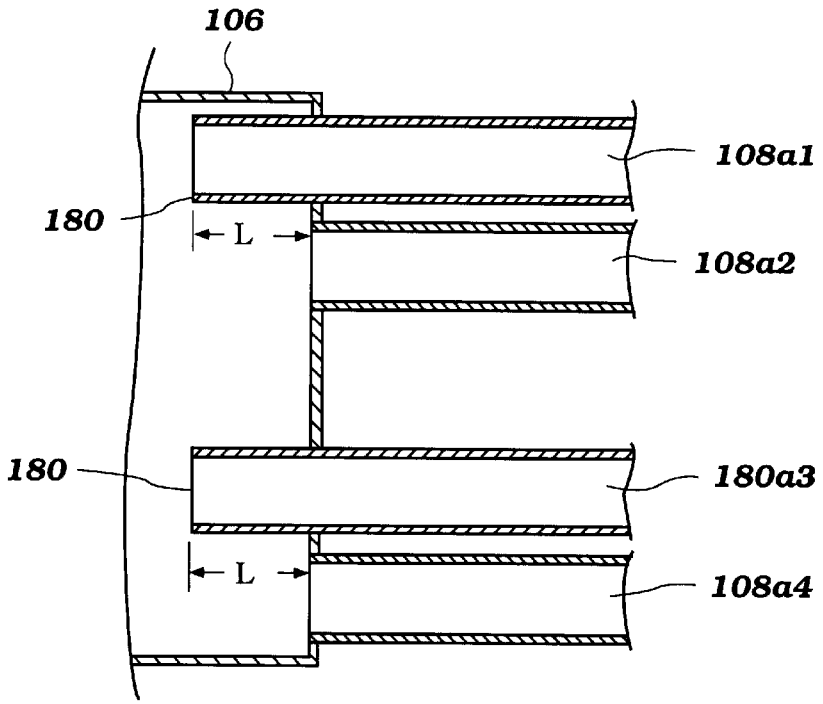
FIG. 5 is a schematic side view showing another embodiment structure in which air intake ducts are connected to the plenum chamber.

With reference to FIG. 5, in this arrangement, upstream portions 180 of the uppermost and the third branch ducts 108 exist in the plenum chamber 106. The length L of the portions 180 existing in the plenum chamber 106 is equal to the difference between the length of the horizontal runners 108*b*1,*b*3 and the length of the inclined runners 108*b*2,*b*4.

Accordingly, the respective lengths of the four intake ducts 108 are the same at all. Since the intake passages 80 have generally the same lengths as each other, the total length of the air intake duct 108 and the intake passage 80 of the respective lines are the same as each other line. In addition, this construction is simple because the plenum chamber 106 can be formed as generally a rectangular box and has only two openings where the upstream portions 180 of the uppermost and the third branch ducts 108 can be inserted.

Figure 6:
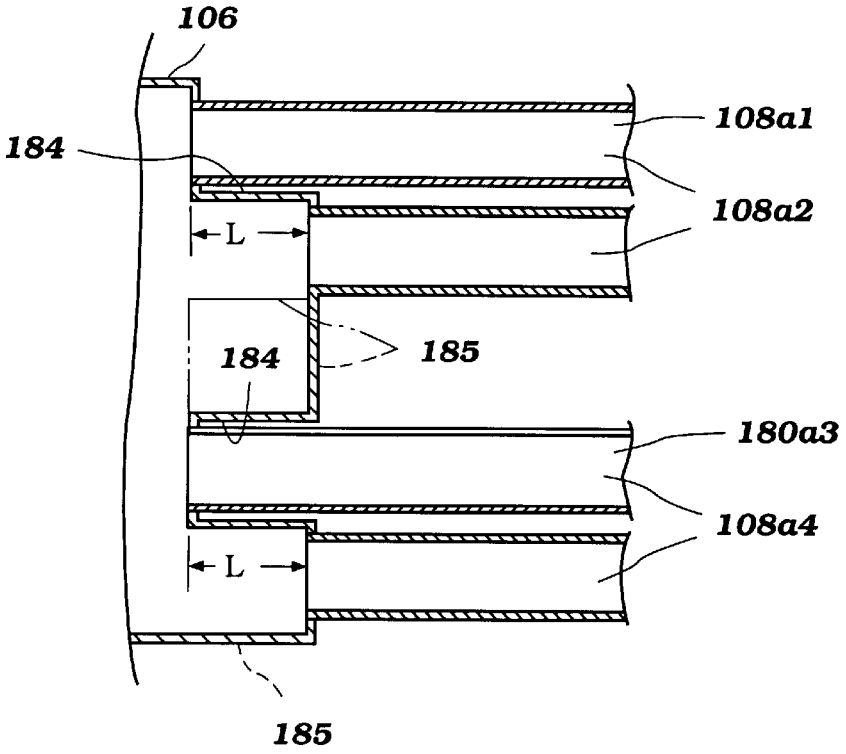
FIG. 6 is a schematic side view showing still another embodiment structure in which the air intake ducts are connected to the plenum chamber.

With reference to FIG. 6, in this arrangement, the plenum chamber 106 has two recesses 184 which depth are L and upstream portions 180 of the uppermost and the third branch ducts 108*a*1,*a*3 are connected to the plenum chamber 106 at the recesses 184. Thus, in the same theory as described above, the respective lengths of the four intake ducts 108 are all the same as each other and then the total length of the air intake duct 108 and the intake passage 80 of the respective lines are the same as each other line also. Further, no protrusion of the upstream portions 180 exists in the plenum chamber 106. Accordingly, air flow in the plenum chamber 106 is smoother than the construction shown in FIG. 5.

The arrangement shown in FIG. 6 was explained such that the plenum chamber 106 has the two recesses 184. However, in a relative concept, it can be depicted that the plenum chamber 106 has two protrusions 185. In addition, the protrusion 185 can be shaped as shown in phantom line.

Figure 7:
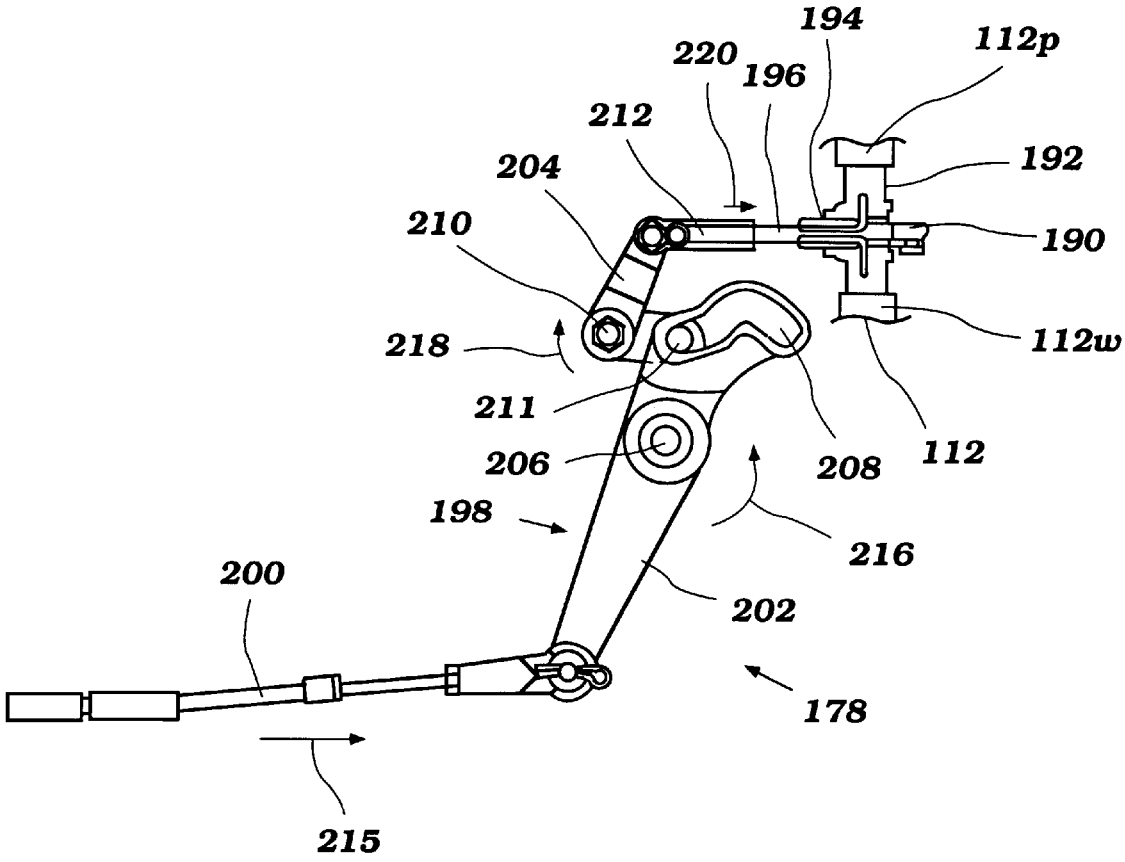
FIG. 7 is an enlarged side elevational view showing a throttle valve control mechanism.

Returning to FIGS. 1 through 4 and additionally with reference to FIG. 7, the throttle valve control mechanism 178 will be described below.

As described above, the respective throttle bodies 110 have throttle valves (not shown) therein and these valves are supported by throttle valve shafts 112 extending vertically. The throttle bodies 110 at the uppermost and second lines have a common throttle valve shaft member 112*p*, while the throttle bodies 110 at the third and bottom lines have another common throttle valve shaft member 112*w*. The upper throttle valve shaft member 112*p* and the lower throttle valve shaft member 112*w* are connected with each other at the aforenoted space 174. A throttle lever 190 is also connected with these members 112*p,w* so as to rotate them. The throttle valve shaft 112 has a return spring 192 urging the throttle shaft 112 to its initial position or angle at which the throttle valves are closed. The return spring 192 is wound around the shaft members 112*p,w* and an urging portion 194 is engaged at the throttle lever 190. The throttle lever 190 is supported by a rod 196 that is a component of a throttle link assembly 198.

The throttle link assembly 198 includes generally a throttle cable 200, a first lever 202 and a second lever 204 in addition to the rod 196. The throttle cable 200 goes forwardly and is connected to an accelerator lever (not shown) placed on, for example, a steering handle (not shown). The first lever 202 is pivotally connected with the throttle cable 200 and pivotally affixed at a first pivot shaft 206 that is mounted on the cylinder block 66 or another portion of the engine 46. The first lever 202 has a cam hole 208 at the opposite end of the connecting portion with the throttle cable 200. The second lever 204 is generally shaped as "L" and pivotally affixed at a second pivot shaft 210 that is mounted on the crankcase 68 or another portion of the engine 46. The second lever 204 has a pin 211 that interfits the cam hole 208. The rod 196 noted above has a length adjuster 212 and the rod 196 is pivotally connected with the second lever 204 via the length adjuster 212. The length adjuster 209 is provided for adjusting an initial position or opening of the throttle valves. The throttle cable 200 is generally positioned at the space 176. A throttle position sensor 213 is affixed at the top of the throttle shaft 112 for sensing throttle openings or angles of throttle valves. This throttle position sensor 213 can be affixed at the bottom or halfway of the throttle shaft 112 if space is available.

Incidentally, a switchover cable 214 is also positioned at the space 176. The switchover cable 214 is a member of a switchover mechanism (not shown) for switching over the forward rotation of the propeller 64 to the reverse rotation and vise versa.

When the throttle cable 200 is moved toward the direction indicated with the arrow 215, the first lever 202 pivots about the first pivot shaft 206 anti-clockwise as indicated with the arrow 216. The second lever 204, then, pivots about the second pivot shaft 210 clockwise as indicated with the arrow 218. Since the pin 211 of the second lever 204 is interfitted in the cam hole 208, the second lever 204 moves along this cam shape. Then, the second lever 204 pushes the throttle rod 196 as indicated with the arrow 220 and finally the throttle valve shaft 112 is rotated via the throttle lever 190 to bring the throttle valves to open positions. When the throttle cable 200 is released, the throttle lever 196 returns to the initial position and the throttle valve shaft 112 is brought into the closed position.

Figure 8:
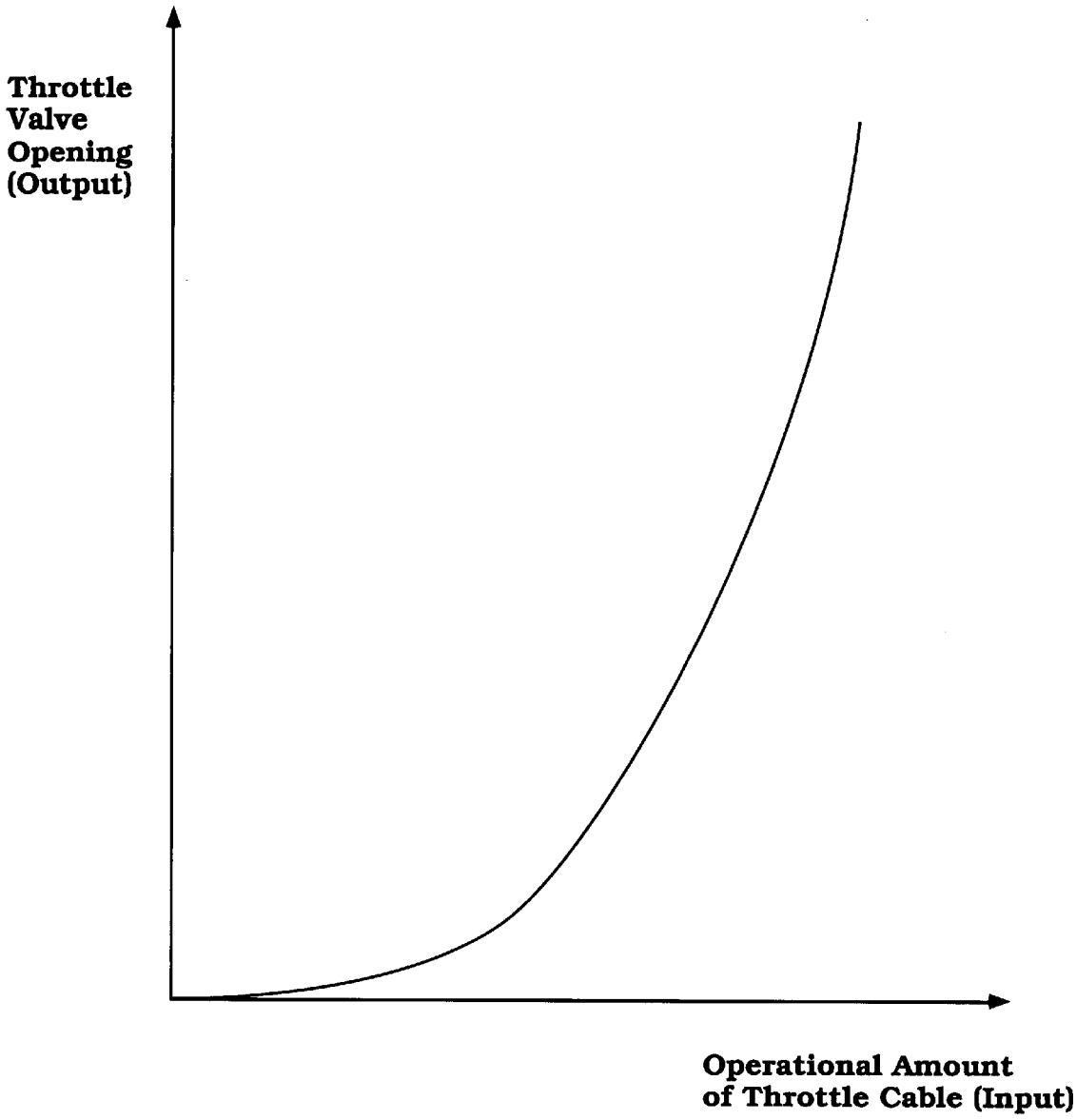
FIG. 8 is a graphical view showing a relationship between the operational amount of a throttle cable and the throttle valve opening.

Since the pin 211 moves along the cam shape as described above, the relationship between the operational amount of the throttle cable 200 and the throttle opening is non-linear as shown in FIG. 8. That is, when the movement of the throttle cable 200 is small, the throttle opening is also small. In the meantime, with the large movement of the throttle cable 200, the throttle valve opening abruptly becomes large. This characteristic is particularly suitable for the operation of the outboard motor 30. Because, the outboard motor 30 is operated quite often at a fixed engine speed within a low or medium speed range. The insensitive change of the throttle valve opening at the small movement of the throttle cable 200 makes it very easy to keep the engine speed in generally fixed state.

The air induction system 104 in this embodiment further has an ISC (idle speed controller) 221 above the vapor separator 130 at the space 142. The ISC 221 is provided for adjusting an amount of air flow to prevent the engine speed from fluctuating at idling state. The ISC 221 is mounted on one of the intake manifold 108*b* in a suitable manner. Because of this mount construction, the ISC 221 is hardly heated up by the engine 46 and rather cooled down like the situation of the vapor separator 130. This construction can be applied also for mounting other components such as electrical equipment, which includes the computerized control unit, a regulator rectifier, and other various devices that should not be heated up.

Figure 9:
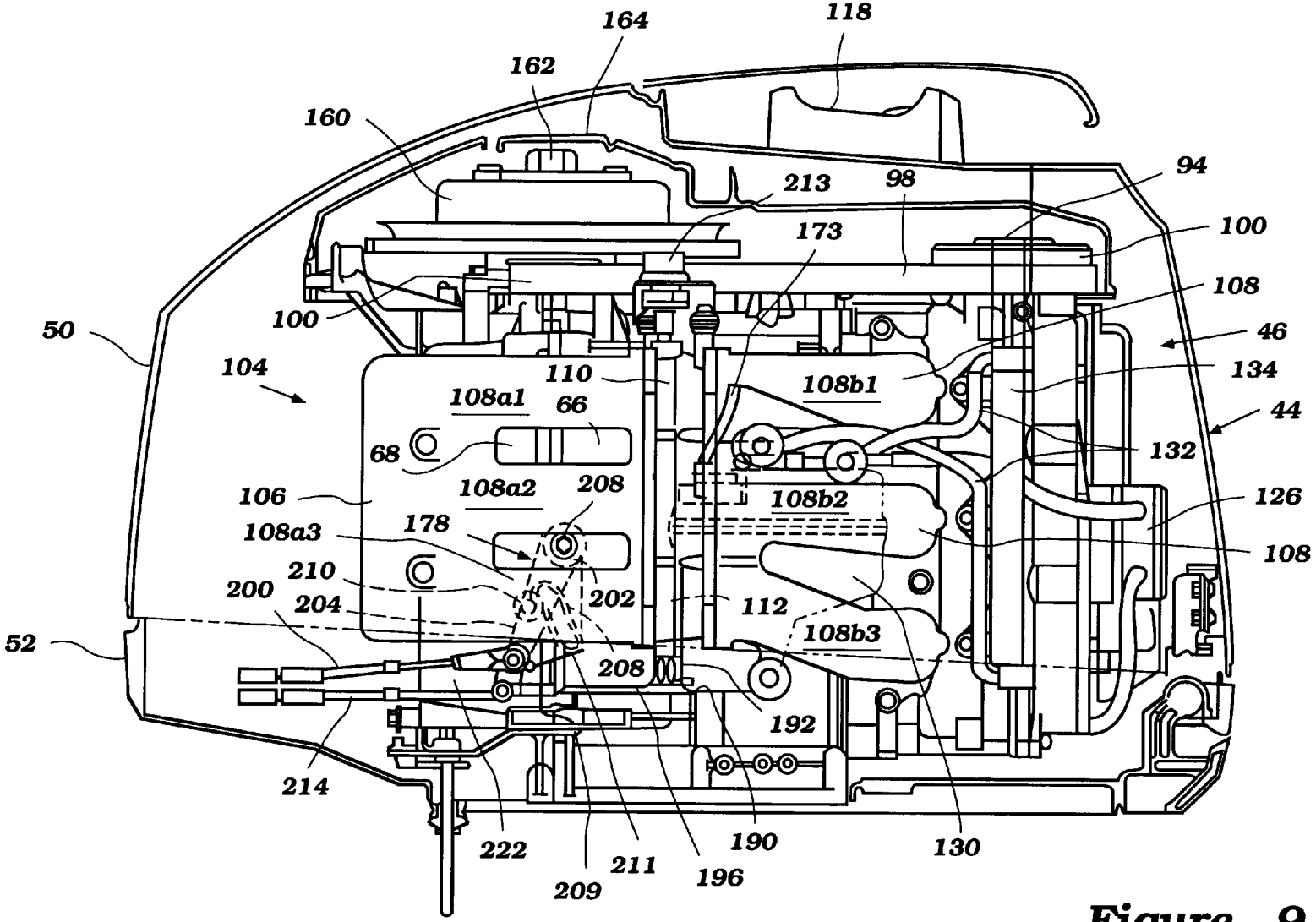
FIG. 9 is an enlarged side elevational view showing a power head incorporating another embodiment of this invention.

FIG. 9 illustrates another embodiment of this invention. The same components and members described above with reference to FIGS. 1 through 7 are assigned with the same reference numerals and will not be described again for avoiding redundancy.

The engine 46 in this embodiment has three cylinders 48 spaced generally vertically relative to each other and the cylinder bores 71 of these cylinders 48 extend generally horizontally. This engine 46, accordingly, has three lines of the air intake ducts 108 comprising the upstream intake duct member 108*a*, the intake manifold 108*b* and the throttle bodies 110 placed between the upstream duct member 108*a* and the intake manifold 108*b*. The upstream branch ducts 108*a*1,*a*2,*a*3 are integrated with the plenum chamber 106, while the runners 108*b*1,*b*2,*b*3 are integrated together with each other so as to form the intake manifold 108*b*. This construction is similar to that of the engine 46 described above and shown in FIGS. 1 through 4.

The first (uppermost) line of the air intake ducts 108 extends generally horizontally along the cylinder bores 71. Meanwhile, the second and third (bottom) lines extend closely to the lines located directly above them as going upstream. Thus, a space 222 is formed under the third (bottom) line of the air intake ducts 108. A part of the throttle valve control mechanism 178 including the throttle cable 200 and the shift cable 214 are placed in this space 222.

A single throttle valve shaft 112 at which three throttle valves are affixed is provided in this embodiment. The throttle control mechanism 178 for controlling the throttle valve shaft 112 is constructed in a slightly different way as compared with the aforedescribed one, but its function is the same. That is, all parts of the first lever 202 is located higher than the bottom portion of the throttle valve shaft 112 and the first lever 202 is pivotally affixed to the engine 46 at its uppermost position with the first pivot shaft 206. Meanwhile, the second lever 204 is positioned generally upside-down in comparison with the position shown in, for example, FIG. 7 and at a halfway of the first lever 202 and pivotally affixed to the engine 46 with the second pivot shaft 210. The pin 211 of the second lever 204 is interfitted in the cam hole 208 formed at a belly portion of the first lever 202. The rod 196 is, thus, located at the lowermost position and connected to the throttle valve shaft 112 via the throttle lever 190 at the space 222.

Figure 10:
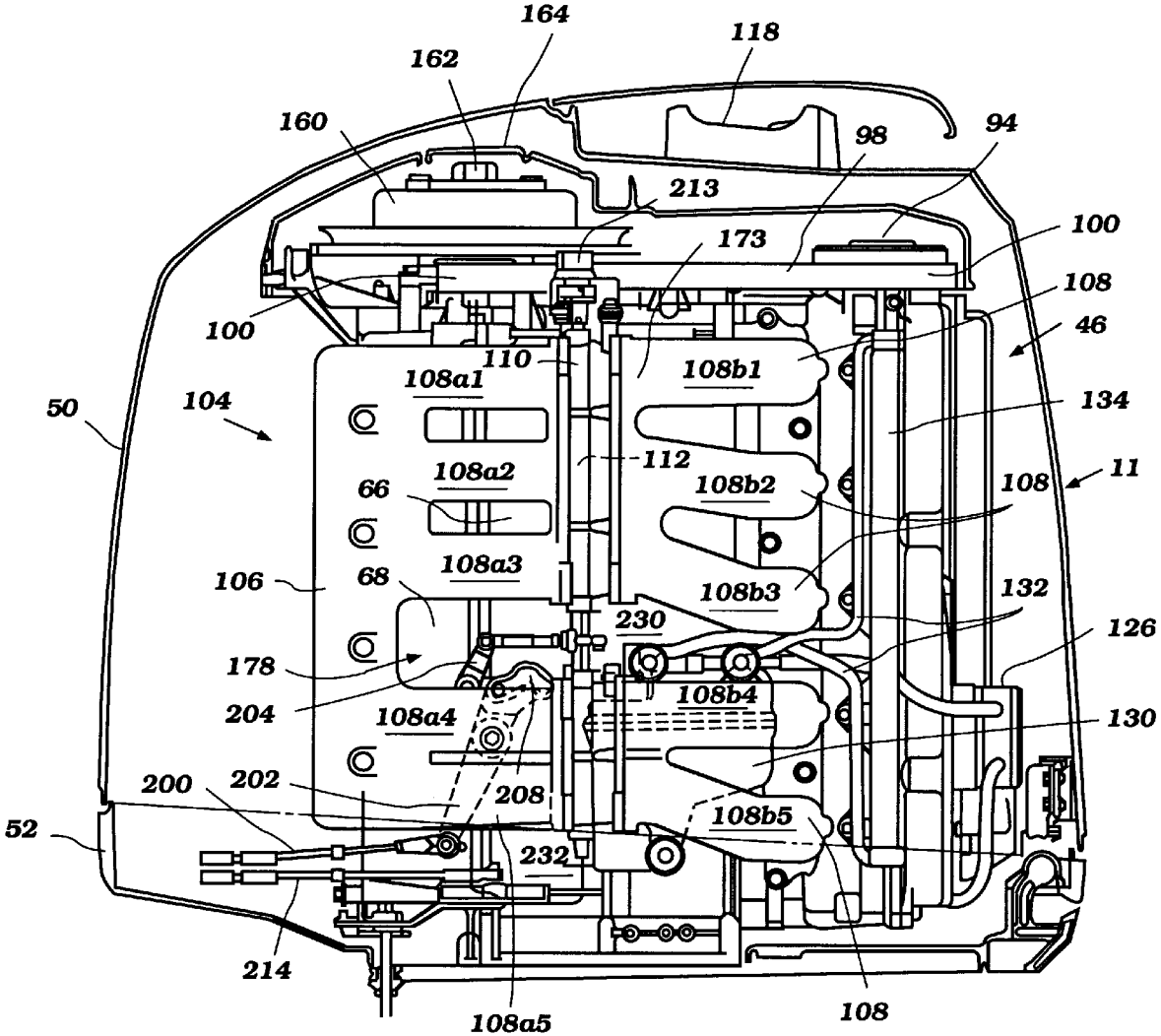
FIG.10 is an enlarged side elevational view showing a power head incorporating still another embodiment of this invention.

FIG. 10 illustrates still another embodiment of this invention. The same components and members will not be described again for the same reason described with the former embodiment.

The engine 46 in this embodiment has five cylinders 48 spaced generally vertically relative to each other and the cylinder bores 71 of these cylinders 48 extend generally horizontally. Also, this engine 46 has five lines of the air intake ducts 108 comprising the upstream intake duct member 108*a*, the intake manifold 108*b* and the throttle bodies 110. The upstream branch ducts 108*a*1,*a*2,*a*3,*a*4,*a*5 are integrated with the plenum chamber 106, while the runners 108*b*1,*b*2,*b*3 are integrated together so as to form one intake manifold 108*b*. Also, the other runners 108*b*4,*b*5 are integrated together so as to form another intake manifold 108*b*. This construction is almost similar to that of the engines 46 described above and shown in FIGS. 1 through 4 and FIG. 9.

The first (uppermost) and the fourth lines of the air intake ducts 108 extend generally horizontally along the cylinder bores 71. Meanwhile, the second, third and fifth (bottom) lines extend closely to the lines located directly above them as going upstream. Thus, a space 230 is formed between the third and fourth lines of the air intake ducts 108 and another space 232 is formed under the fifth (bottom) line. The construction and the arrangement of the throttle valve control mechanism 178 is the same as described in the first embodiment and shown in FIGS. 1 through 4 and FIG. 7. That is, the upper part of the throttle control mechanism 178 faces the space 230 and the lower part thereof faces the space 232 as seen in FIG. 10.

The air intake ducts 108 can have various configurations other than the configurations described above. For instance, instead of the inclined runners, the upstream duct members in the same lines can be inclined.

Generally, the engine may have other number of cylinders and even a single cylinder is available inasmuch as the following claims do not recite otherwise.

Also, the engine can have the V-shape or other various configurations.

Further, the locations of the air induction system and the exhaust system are exchangeable.

The aforedescribed fuel injectors can be replaced with other types of fuel injectors such that directly spraying fuel into the combustion chambers. Even conventional carburetors can replace the fuel injectors.

Furthermore, this engine can be utilized for other various purposes, for example, other vehicles such as lawn mowers and golf carts.

Of course, the foregoing description is that of preferred embodiments of the invention, and various changes and modifications may be made without departing from the spirit and scope of the invention, as defined by the appended claims.

What is claimed is:

1. A four stroke internal combustion engine comprising a plurality of generally horizontally extending cylinder bores having their axis spaced vertically relative to each other, a plurality of pistons each reciprocating within each one of said cylinder bores, a cylinder head closing one end of said cylinder bores, said cylinder bores, said pistons and said cylinder head generally defining respective combustion chambers for burning intake charges, said cylinder head having a plurality of air intake passages communicating with said combustion chambers for supplying at least air charge thereto, said engine further comprising a plurality of air intake ducts each defining a center axis and being connected to a respective one of said air intake passages, each one of said air intake ducts having a generally straight section extending generally horizontally and generally in parallel to each other, a distance between said center axes of said straight sections being less than a distance between axes of said cylinder bores.

2. A four stroke internal combustion engine as set forth in claim 1 wherein at least an uppermost of the plurality of intake ducts extends generally wholly straightly.

3. A four stroke internal combustion engine as set forth in claim 1 wherein at least an intake duct positioned second from the uppermost intake duct has an oblique section extending upwardly toward said straight section from a portion connected to an intake passage positioned second from the uppermost intake passage.

4. A four stroke internal combustion engine as set forth in claim 3 wherein said engine has four cylinders, and an intake duct positioned third from the uppermost intake duct extends generally wholly horizontally, and an intake duct positioned fourth from the uppermost intake duct has an oblique section extending upwardly toward said straight section from a portion connected to an intake passage positioned fourth from the uppermost intake passage.

5. A four stroke internal combustion engine as set forth in claim 3 wherein said engine has three cylinders, and the uppermost intake duct extends generally wholly straightly, second and third intake ducts of the plurality of air intake ducts extending closely to intake ducts positioned directly above said second and third intake ducts.

6. A four stroke internal combustion engine as set forth in claim 3 wherein said engine has five cylinders, and the uppermost intake duct and an intake duct positioned fourth from the uppermost intake duct extend generally wholly straightly, and second, third and fifth intake ducts of the plurality of air intake ducts extending closely to intake ducts positioned directly above said second, third and fifth intake ducts.

7. A four stroke internal combustion engine as set forth in claim 1 wherein said air intake ducts have generally a same length as each other.

8. A four stroke internal combustion engine as set forth in claim 7 wherein said engine further comprises a plenum chamber upstream of said air intake ducts for smoothing the air charge, and at least an uppermost air intake duct has an upstream portion existing in said plenum chamber.

9. A four stroke internal combustion engine as set forth in claim 7 wherein said engine further comprises a plenum chamber upstream of said air intake ducts for smoothing the air charge, and said plenum chamber has a recess at which an upstream portion of at least an uppermost air intake duct is connected to said plenum chamber.

10. A four stroke internal combustion engine as set forth in claim 1 wherein said engine further comprises a plenum chamber disposed upstream of said air intake ducts for smoothing the air charge.

11. A four stroke internal combustion engine as set forth in claim 10 wherein said plenum chamber is positioned generally opposite said air intake passages.

12. A four stroke internal combustion engine as set forth in claim 1 wherein each intake duct includes a throttle body having a valve for controlling flow of the air charge to the respective combustion chamber.

13. A four stroke internal combustion engine as set forth in claim 12 wherein each one of said air intake ducts comprises at least three pieces, a first piece defining said throttle body being interposed between the other two pieces.

14. A four stroke internal combustion engine as set forth in claim 1 wherein said engine is a constituent of an outboard engine and is encircled by a protective cowling.

15. A four stroke internal combustion engine as set forth in claim 1, wherein each one of said air intake ducts being connected to a different one of said combustion chambers.

16. A four stroke internal combustion engine comprising a plurality of generally horizontally extending, vertically spaced cylinder bores, a plurality of pistons each reciprocating within each one of said cylinder bores, a cylinder head closing one end of said cylinder bores, said cylinder bores, said pistons and said cylinder head defining combustion chambers for burning intake charges, a crankcase member closing the other ends of said cylinder bores and defining at least in part a crankcase chamber, a crankshaft rotated by the reciprocal movement of said pistons within the crankcase chamber, said cylinder head having a plurality of air intake passages each communicating with each one of said combustion chambers for supplying at least an air charge thereto, a plenum chamber having an atmospheric air inlet juxtaposed to said crankcase member, a plurality of generally horizontally extending, vertically spaced duct members extending from said plenum chamber along one side of said engine toward said intake passages, and a fuel supply system for supplying fuel that is another component of the intake charge to said combustion chamber, said fuel supply system having at least a vapor separator for separating vapor from the fuel, and said vapor separator being mounted on one of said duct members and placed between the one side of said engine and said duct members.

17. A four stroke internal combustion engine as set forth in claim 16 wherein said fuel supply system further has at least one fuel injector for spraying the fuel into said air intake passage, and said vapor separator is placed upstream of said fuel injector in said fuel supply system.

18. A four stroke internal combustion engine comprising a plurality of generally horizontally extending, vertically spaced cylinder bores, a plurality of pistons each reciprocating within each one of said cylinder bores, a cylinder head closing one end of said cylinder bores, said cylinder bores, said pistons and said cylinder head defining combustion chambers for burning intake charges, a crankcase member closing the other ends of said cylinder bores and defining at least in part a crankcase chamber, a crankshaft rotated by the reciprocal movement of said pistons within the crankcase chamber, said cylinder head having a plurality of air intake passages each communicating with each one of said combustion chambers for supplying at least an air charge thereto, a plenum chamber having an atmospheric air inlet juxtaposed to said crankcase member, a plurality of generally horizontally extending, vertically spaced duct members extending from said plenum chamber along one side of said engine toward said intake passages, and an idle speed controller for adjusting an amount of the air charge to prevent engine speed from fluctuating at idling state.

19. A four stroke internal combustion engine comprising a plurality of generally horizontally extending, vertically spaced cylinder bores, a plurality of pistons each reciprocating within each one of said cylinder bores, a cylinder head closing one end of said cylinder bores, said cylinder bores, said pistons and said cylinder head defining combustion chambers for burning intake charges, a crankcase member closing the other ends of said cylinder bores and defining at least in part a crankcase chamber, a crankshaft rotated by the reciprocal movement of said pistons within the crankcase chamber, said cylinder head having a plurality of air intake passages each communicating with each one of said combustion chambers for supplying at least an air charge thereto, a plenum chamber having an atmospheric air inlet juxtaposed to said crankcase member, a plurality of generally horizontally extending, vertically spaced duct members extending from said plenum chamber along one side of said engine toward said intake passages, and said duct members including a plurality of throttle bodies for controlling flow of the air charge to said combustion chambers, each one of said throttle bodies having a throttle valve, each one of said throttle valves having a shaft extending generally vertically, all of said shafts being linked together, and a position sensor for sensing opening positions of said throttle valves, and said position sensor being located on said shafts.

20. A four stroke internal combustion engine as set forth in claim 19 wherein said position sensor is located at the end of said shafts.

21. A four stroke internal combustion engine as set forth in claim 20 wherein said position sensor is located at the upper end of said shafts.

22. An internal combustion engine comprising a cylinder body including a plurality of cylinder bores extending generally horizontally, each one of the cylinder bores having a first axis extending generally horizontally and spaced apart vertically from one another by a first distance, a plurality of pistons each reciprocating within each one of the cylinder bores, a cylinder head member closing one end of the cylinder bores to define a plurality of combustion chambers with the cylinder bores and the pistons, the cylinder head member defining a plurality of intake ports each communicating with each one of the combustion chambers, and a plurality of intake conduits each coupled with each one of the intake ports, each one of the intake conduits including a first section extending generally horizontally and a second section coupling the first section with one of the intake ports, each one of the first section having a second axis extending generally horizontally and spaced apart vertically from one another by a second distance, the second distance being less than the first distance.

23. The internal combustion engine as set forth in claim 22, wherein at least the second section of an uppermost of the plurality of intake conduits defines a third axis extending generally horizontally consecutively from the second axis of the first section of the uppermost intake conduit.

24. The internal combustion engine as set forth in claim 23, wherein the second section of at least one of the intake conduits, other than the uppermost, has a fourth axis extending generally horizontally consecutively from the second axis of the associated first section and generally in parallel to the third axis.

25. The internal combustion engine as set forth in claim 23, wherein the second section of at least one of the intake conduits, other than the uppermost, extends downwardly toward the associated intake port from the associated first section.

26. The internal combustion engine as set forth in claim 22, wherein the second section of an intake conduit positioned next to an uppermost intake conduit extends downwardly toward the associated intake port from the associated first section.

* * * * *

UNITED STATES PATENT AND TRADEMARK OFFICE

CERTIFICATE OF CORRECTION

PATENT NO. : 6,286,472 B1
DATED : September 11, 2001
INVENTOR(S) : Masanori Takahashi and Goichi Katayama It is certified that error appears in the above-identified patent and that said Letters Patent is hereby corrected as shown below:

Title page,
Item [56], References Cited, please add the following references:
-- 5,513,606 5/1996 Shibata.....1234/184.34 --
-- 5,488,939 2/1996 Nikai et al.....123/527 --

Signed and Sealed this

Seventh Day of May, 2002

*Attest:*

*Attesting Officer*

JAMES E. ROGAN
*Director of the United States Patent and Trademark Office*